US009931556B2

(12) United States Patent
Cosma

(10) Patent No.: US 9,931,556 B2
(45) Date of Patent: Apr. 3, 2018

(54) RIDING TRAINER

(71) Applicant: Christopher Cosma, Brooklyn, NY (US)

(72) Inventor: Christopher Cosma, Brooklyn, NY (US)

( * ) Notice: Subject to any disclaimer, the term of this patent is extended or adjusted under 35 U.S.C. 154(b) by 301 days.

(21) Appl. No.: 14/842,360

(22) Filed: Sep. 1, 2015

(65) Prior Publication Data

US 2017/0056744 A1 Mar. 2, 2017

(51) Int. Cl.
*A63B 69/00* (2006.01)
*A63B 69/04* (2006.01)

(52) U.S. Cl.
CPC ..... *A63B 69/04* (2013.01)

(58) Field of Classification Search
USPC ..... 434/247; 472/95, 99, 100, 102; 297/271.1, 271.3, 271.5
See application file for complete search history.

(56) References Cited

U.S. PATENT DOCUMENTS 2,921,789 A * 1/1960 Skinner, Sr. ..... A63G 13/06 446/325
4,025,107 A * 5/1977 Chippa ..... A47C 3/029 108/116
4,084,273 A * 4/1978 Haynes ..... A47D 13/06 297/270.1
4,576,374 A * 3/1986 Thomas ..... A63G 13/06 280/1.177
5,152,719 A * 10/1992 Nolan ..... A63G 13/06 472/101
5,238,455 A * 8/1993 Cain, Jr. ..... A63G 13/06 472/102
6,386,635 B1 * 5/2002 Ralph ..... B60N 2/502 297/314
6,834,916 B2 * 12/2004 Volkman ..... A47C 9/027 297/270.1
7,008,360 B1 * 3/2006 Smith ..... A63B 21/00047 482/146
7,070,415 B2 * 7/2006 Hojo ..... A63B 26/003 434/247
7,156,790 B2 * 1/2007 Johnsen ..... A63B 21/0004 482/112
7,201,709 B1 * 4/2007 Pebbles, Jr. ..... A63B 69/04 472/106
7,478,878 B2 * 1/2009 Oettinger ..... A47C 3/029 297/271.5
7,736,277 B2 * 6/2010 Nakanishi ..... A63B 26/003 434/247
7,775,939 B2 * 8/2010 Nakanishi ..... A61H 1/001 434/247

(Continued)

OTHER PUBLICATIONS

"HomeHorse Demonstration" (Home Horse) Nov. 6, 2015 (Nov. 6, 2015) [online] retrieved from <URL: https://vimeo.com/144885576> entire document, especially 00:03, 00:09, and 00:25.

*Primary Examiner* — Kurt Fernstrom
(74) *Attorney, Agent, or Firm* — Daniel M. Cohn; Howard M. Cohn

(57) ABSTRACT

A horse shaped riding trainer and method of constructing a horse shaped riding trainer. The riding trainer includes a horse shaped riding structure, a convex shaped, rotating platform, and a post for mounting the horse shaped riding structure to the convex shaped, rotating platform.

19 Claims, 6 Drawing Sheets

(56) References Cited

U.S. PATENT DOCUMENTS

| | | | | |
|---|---|---|---|---|
| 7,914,386 | B1 * | 3/2011 | Johns | A63G 19/04 434/247 |
| 7,931,565 | B2 * | 4/2011 | Nakano | A63B 24/00 434/247 |
| 8,540,519 | B1 * | 9/2013 | Lauter | A63B 26/003 434/247 |
| 8,852,010 | B2 * | 10/2014 | Garner | A63G 19/20 434/247 |
| 2003/0020312 | A1 | 1/2003 | Wang | |
| 2003/0073504 | A1 | 4/2003 | Ettenhofer | |
| 2003/0164633 | A1 | 9/2003 | Barclay et al. | |
| 2004/0101811 | A1 * | 5/2004 | Gipson | A63B 69/0068 434/247 |
| 2007/0138850 | A1 | 6/2007 | Oettinger | |
| 2008/0009395 | A1 * | 1/2008 | Tseng | A63B 69/04 482/51 |
| 2008/0293554 | A1 | 11/2008 | Chou | |
| 2009/0001788 | A1 * | 1/2009 | Lenz | A47C 9/002 297/217.4 |
| 2010/0009762 | A1 * | 1/2010 | Takeda | A63B 69/04 463/47 |
| 2011/0217682 | A1 * | 9/2011 | Bland | A63B 26/003 434/247 |
| 2015/0351549 | A1 * | 12/2015 | Chadwick | A47C 3/029 297/311 |

* cited by examiner

RIDING TRAINER

TECHNICAL FIELD OF THE INVENTION

The present invention relates to a horse shaped riding trainer. More specifically, the present invention relates to a horse shaped riding structure, a convex shaped, rotating platform, and a post for mounting the horse shaped riding structure to the convex shaped, rotating platform.

BACKGROUND OF THE INVENTION

For centuries throughout the world, horseback riding has captured the imagination of adventurous people. In the time of the ancient Greeks and Romans, the horse was a symbol of power. In medieval Europe and Japan, horses were essential for quick movement across large distances and were often used in warfare. In the American wild west, the horse was a cowboy's constant companion and a symbol of self-reliance and adventure. While few experiences may compare with the fun and excitement an experienced rider has galloping a real horse, many of us do not have sufficient training and experience and/or ready access to live horses.

It is generally known that the act of riding a horse must be practiced in order to learn balance, prevent falling, and to exercise the muscles of the back and leg to develop strength. At the present time, the general method for a person to learn to ride in a balanced position at the walk, trot and canter is to practice their technique by riding a horse. However, individuals interested in learning to ride may not have a horse available with which to practice, and individuals who own a horse may not be able to practice because of bad weather, ailments sustained by their horse or any other number of reasons. Furthermore, beginning riders need many hours of practice to perfect their balanced position at the walk, trot, and canter so that they can ride with a safe and secure seat. The disadvantage of having only real horses available for the beginner is that because of the beginner's lack of skill, he or she is at a greater risk of falling off the horse and possibly sustaining injuries while learning the basics of balance and coordination required between the horse and rider. There has never been an economical device for riding students to practice riding techniques and build strength and balance between their riding lessons until this invention.

SUMMARY OF THE INVENTION

According to an embodiment of the present invention, there is disclosed a horse shaped riding trainer. The riding trainer includes a horse shaped riding structure, a convex shaped, rotating platform, and a post for mounting the horse shaped riding structure to the convex shaped, rotating platform.

According to another embodiment of the present invention, there is disclosed a method for constructing a horse shaped riding trainer. The method includes providing a horse shaped riding structure. The method further includes forming a convex shaped, rotating platform. Finally, the method includes mounting the horse shaped riding structure to the convex shaped, rotating platform with an elongated, adjustable post including an elongated, adjustable post having a plurality of openings along the length thereof and a hollow, post container having an opening at one end to receive the elongated adjustable post and a second support plate secured to an opposite end thereof.

BRIEF DESCRIPTION OF THE DRAWINGS

The structure, operation, and advantages of the present invention will become further apparent upon consideration of the following description taken in conjunction with the accompanying figures (FIGs.). The figures are intended to be illustrative, not limiting. Certain elements in some of the figures may be omitted, or illustrated not-to-scale, for illustrative clarity. The cross-sectional views may be in the form of "slices", or "near-sighted" cross-sectional views, omitting certain background lines which would otherwise be visible in a "true" cross-sectional view, for illustrative clarity.

In the drawings accompanying the description that follows, both reference numerals and legends (labels, text descriptions) may be used to identify elements. If legends are provided, they are intended merely as an aid to the reader, and should not in any way be interpreted as limiting.

DETAILED DESCRIPTION OF THE PREFERRED EMBODIMENTS

Figure 1:
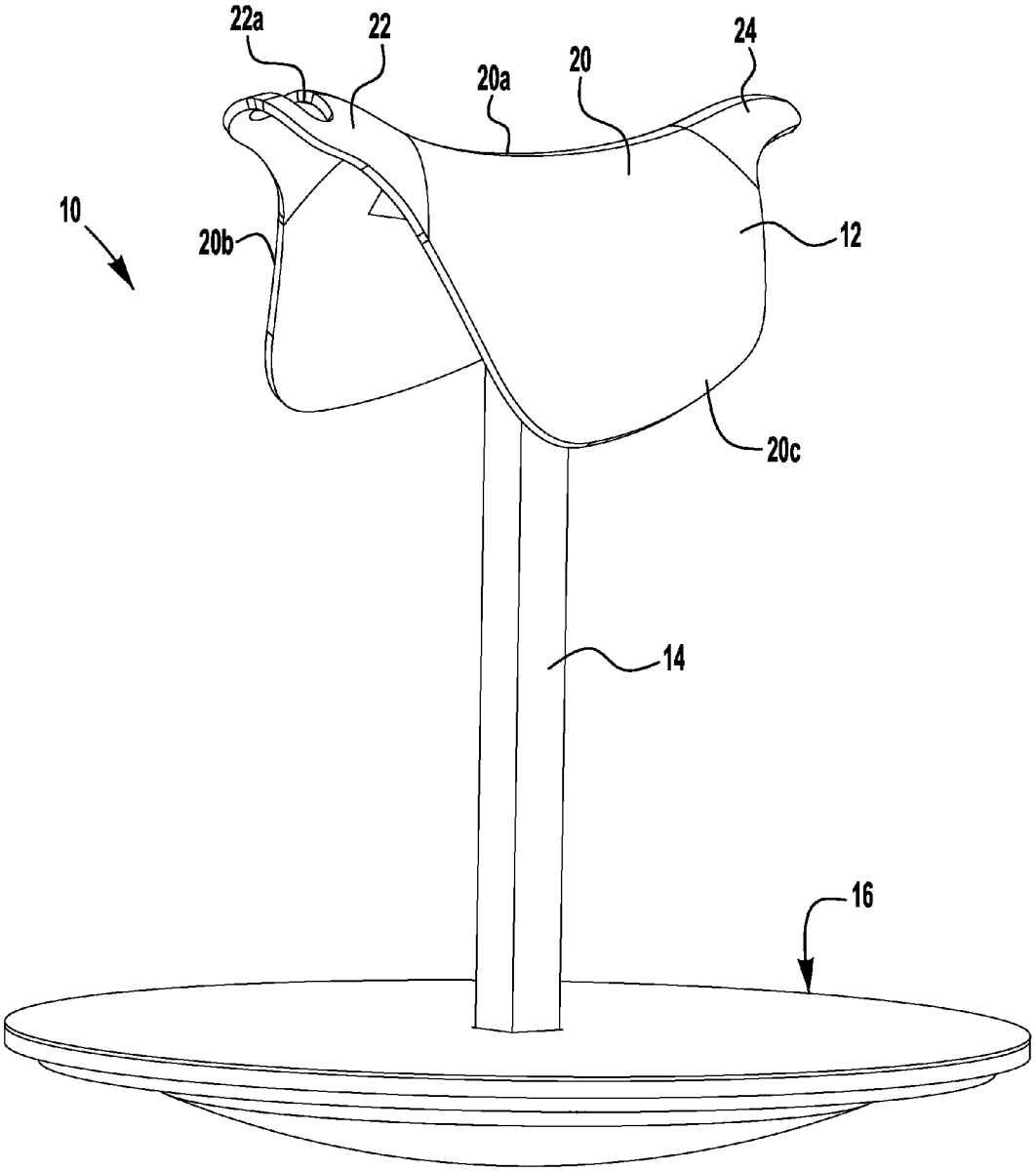
FIG. 1 is a front, three dimensional view of the riding trainer, in accordance with the present invention.

In the description that follows, numerous details are set forth in order to provide a thorough understanding of the present invention. It will be appreciated by those skilled in the art that variations of these specific details are possible while still achieving the results of the present invention. Well-known processing steps are generally not described in detail in order to avoid unnecessarily obfuscating the description of the present invention.

In the description that follows, exemplary dimensions may be presented for an illustrative embodiment of the invention. The dimensions should not be interpreted as limiting. They are included to provide a sense of proportion. Generally speaking, it is the relationship between various elements, where they are located, their contrasting compositions, and sometimes their relative sizes that is of significance.

In the drawings accompanying the description that follows, often both reference numerals and legends (labels, text descriptions) will be used to identify elements. If legends are provided, they are intended merely as an aid to the reader, and should not in any way be interpreted as limiting.

It is necessary for those wishing to improve their horse riding technique to ride regularly in order to maintain their fitness and to practice and improve riding technique. However, it is not always possible for a rider to have sufficient rides to maintain his fitness and to practice technique, and indeed in adverse weather conditions it may not be possible to ride at all without the risk of serious injury to the horse and/or the rider. There is also a significant problem with riders who are recovering from injury. Not only might it be dangerous for a recovering rider to ride a horse when not fully fit, but it might also be necessary for a rider to exercise the injured area more thoroughly to build up strength again.

The horse shaped riding trainer 10 is designed as a type of fitness equipment used to simulate horse riding. The horse shaped riding trainer 10 provides a natural physical exercise promoting metabolism and making the individual slimmer and healthier. In general terms, the horse shaped riding trainer 10 incorporates a horse shaped structure 12 secured upon a post 14, which is attached to a convex shaped, rotating platform 16. While utilizing the horse shaped riding trainer 10, the rider must attempt to remain sitting upon the horse shaped structure 12 without falling over. This activity has the effect of strengthening and conditioning the rider, activating several muscle groups to enhance the rider's fitness. Further, the exercise of remaining stable upon the riding trainer 10 acts as an effective cardiovascular workout. Using the riding trainer 10 has the added benefit of allowing the rider to practice his saddle technique and positioning without actually necessitating a real horse. This is invaluable in situations where accessing a live horse would be otherwise difficult or impossible.

As illustrated in FIG. 1, the horse shaped riding trainer 10 consists of a horse shaped riding structure 12, a post 14, and a convex shaped, rotating platform 16. The horse shaped riding trainer 10 is typically constructed of a wood, leather, metal, rubber or plastic or some combination of these materials.

Figure 3:
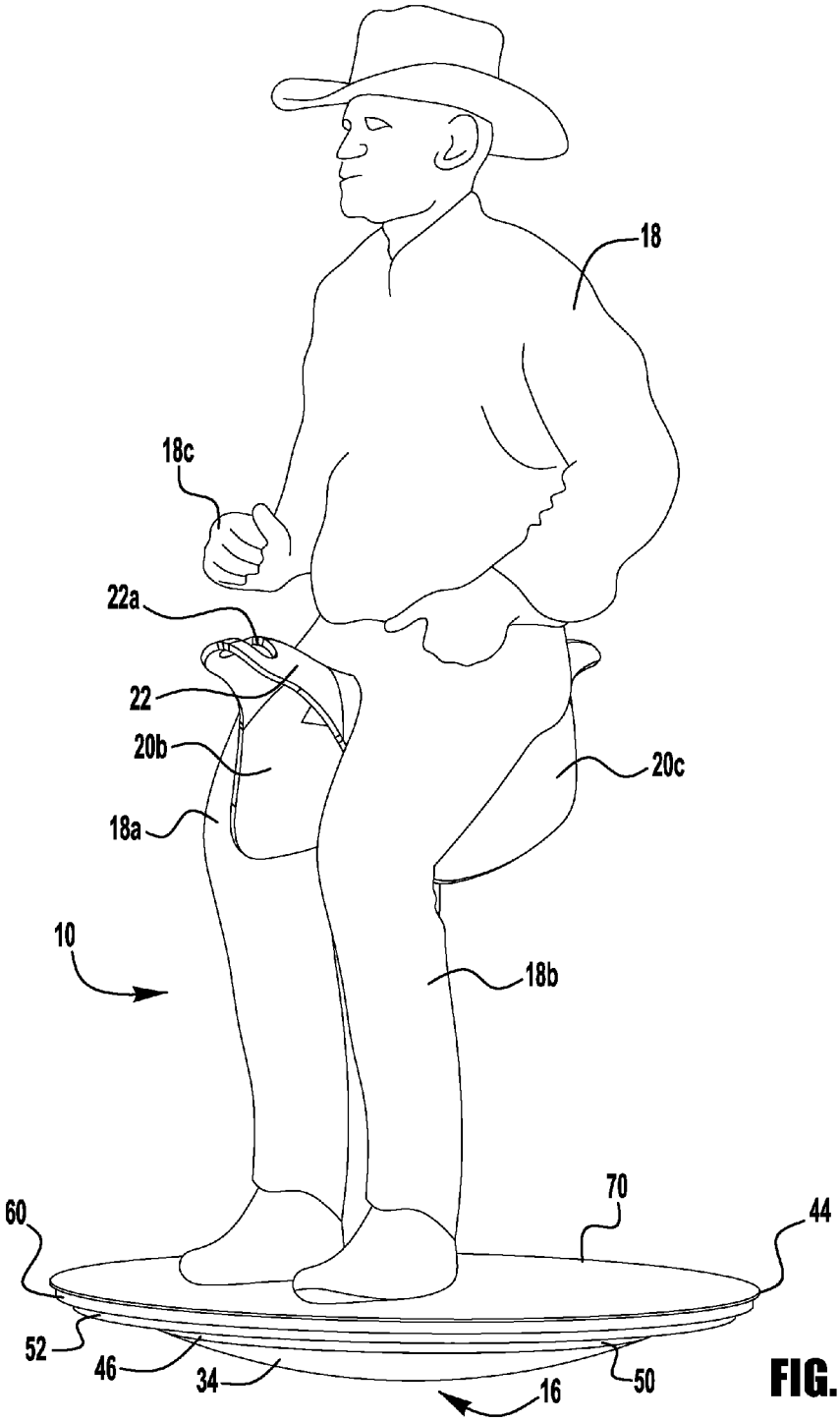
FIG. 3 is a front, three dimensional view of the riding trainer in use with a rider, in accordance with the present invention.

As shown in FIG. 3, the rider 18 straddles the horse shaped riding trainer 10 as would be done on a real horse. The horse shaped riding structure 12 is shaped to mimic the shape of a real horse. The horse shaped riding structure 12 consists of a main body 20, with a front end portion 22 and a rear end portion 24. The horse shaped structure 12 may have any appropriate dimensions, and it must be sufficiently sturdy to support the weight of a variety of different sized riders 18. Alternatively, the horse shaped riding trainer 10 may have a variety of sized horse shaped riding structures 12, which allow the rider 18 to customize the size of the horse shaped riding structure based on his or her needs.

The horse shaped riding structure 12 is horseback shaped, enabling a saddle to be received thereon. In addition the surface of the horse shaped riding structure 12 is substantially smooth, enabling the body to be ridden in bareback style. In some cases a blanket can be placed across the surface of the horse shaped riding structure 12 to make the riding more comfortable.

The main body 20 includes an upper portion 20*a*, upon which the rider 18 sits, and two sloping sidewall portions 20*b* and 20*c* which support the legs 18*a* and 18*b*, respectively, of the rider as shown in FIG. 3. The front end portion 22 of the horse shaped structure 12 acts as a gripping portion which enables the rider 18 to grip the horse shaped structure in use, supporting himself astride it. There may be an opening 22*a* through the front end portion 22 to allow the rider 18 to insert his hand 18*c* for a more secure grip. The rear end portion 24 extends in an upward slope from the main body 20. The rear end portion 24 is generally designed to prevent the rider 18 from simply sliding off the upper portion 20*a* of the main body 20.

Figure 2:
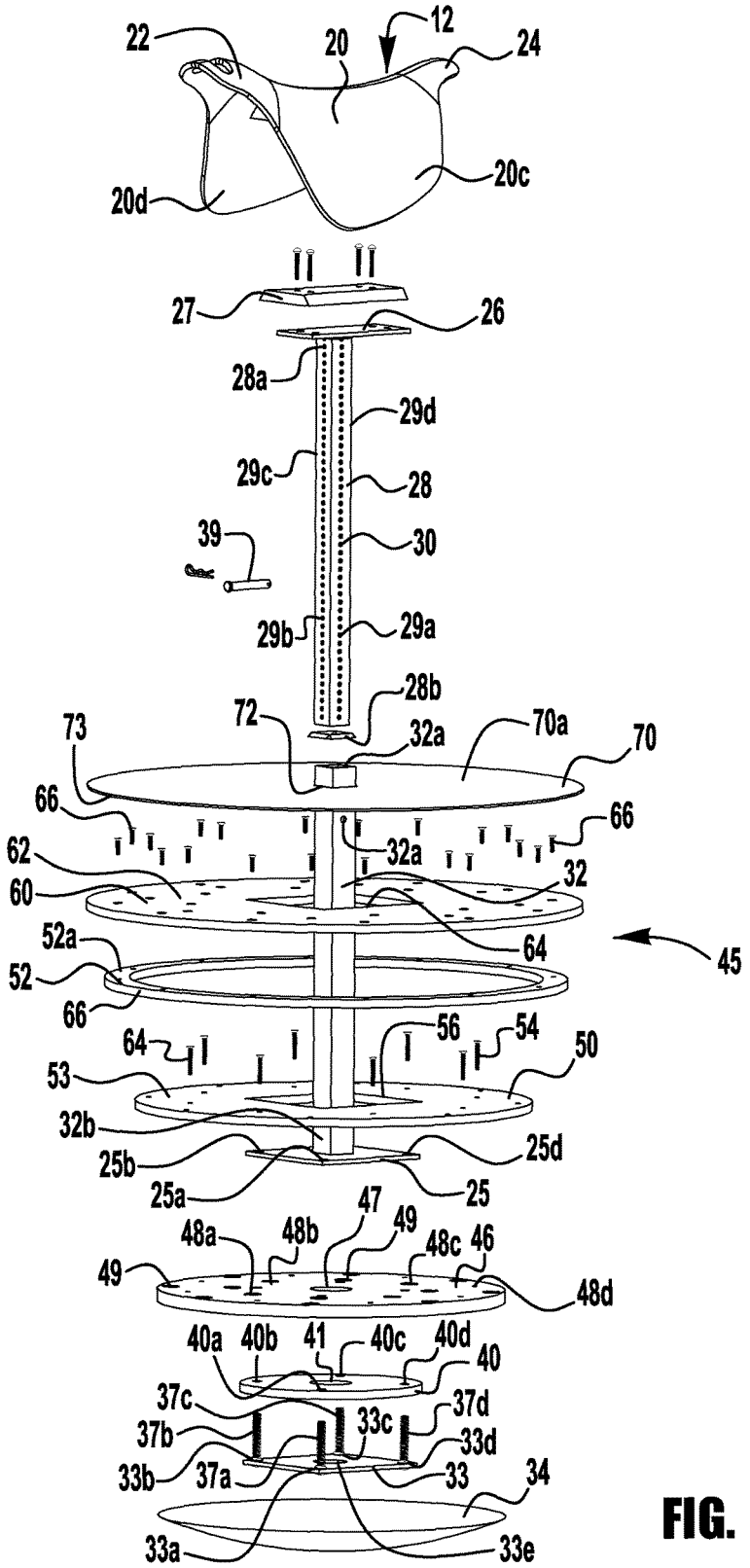
FIG. 2 is an exploded view of the components of the riding trainer, in accordance with the present invention.

As illustrated in FIG. 2, the underside 20*d* of the horse shaped structure 12 is secured to a first plate 26, which is permanently disposed atop an elongated, adjustable post 28 at a first top end 28*a*. Preferably, there are openings 26*a*, 26*b*, 26*c* and 26*d* within the plate 26 to allow screws or other attachment devices, such as nails, to firmly secure the plate to a mounting block 27 attached to the underside 20*d* of the horse shaped structure 12. While the plate 26 is typically formed from metal, it can be constructed from any strong, rigid material. The adjustable post 28 is typically rectangular in shape and contains a plurality of openings 30 extending along the length of each of its four walls 29*a*, 29*b*, 29*c*, and 29*d* (29*a*-29*d*). The openings 30 on each of the walls 29*a*-29*d* align with each other. The post 28 may be of any appropriate dimensions, such as a height with a range between 10 inches and 36 inches, and a width with a range between 1 inches and 2.5 inches.

The post 14 includes the elongated, adjustable post 28 and a hollow post container 32 which has an opening at one end 32*a* at one end which is shaped to receive the adjustable post 28. At an opposite end 32*b* of post container 32 is attached a square of rectangular support plate 25, typically constructed of metal having openings 25*a*, 25*b*, 25*c* and 25*d* (25*a*-25*d*), preferably at each corner, there through. While the plate 25 is typically formed from metal, it can be constructed from any strong, rigid material.

Figure 2A:
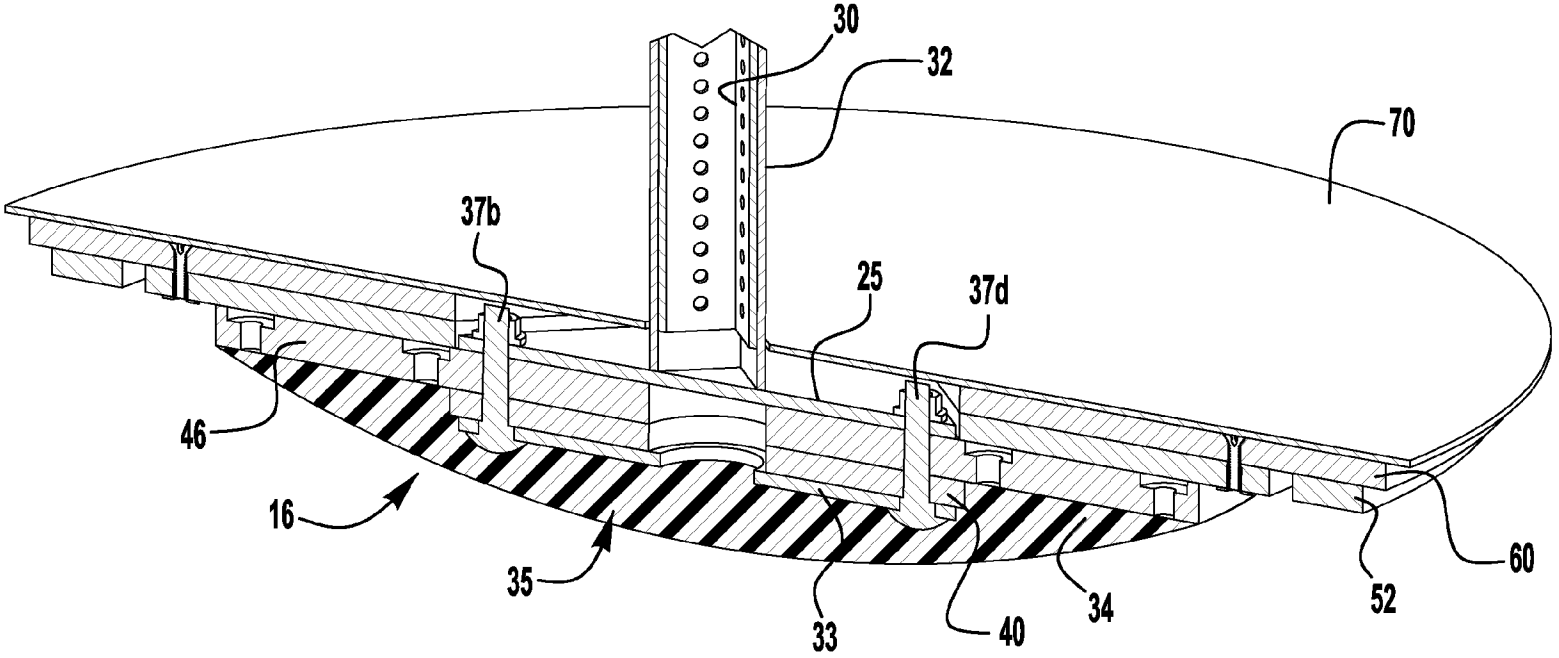
FIG. 2A is a cross sectional view showing the convex shaped, rotating platform, in accordance with the present invention.

The convex shaped, rotating platform 16 includes a convex shaped, hemispherical bottom support 34, as seen in FIG. 2A, which is formed of a molded, elastic material such as an elastomer or rubber with a lower bundle of plates 35 molded therein. The lower bundle of plates 35 includes the metal plate 33, a first disk shaped plate 40, and second disk shaped plate 40.

The metal support plate 33 has four openings 33*a*, 33*b*, 33*c*, and 33*d* on each corner of the metal plate. Four bolts 37*a*, 37*b*, 37*c* and 37*d* (37*a*-37*d*) extend upwardly through the holes and project above the support plate 33. Metal plate 33 includes a central opening 33*e* there through to help with the manufacture of the convex shaped, rotating platform 16, as explained hereinafter.

Directly above the metal plate 33 is a first disk shaped plate 40 which contains four holes 40*a*, 40*b*, 40*c*, and 40*d* (40*a*-40*d*) through which the four bolts 37*a*-37*d* project as shown in FIG. 2A. The first disk shaped plate 40 has a diameter with a range between 6 inches and 18 inches. There is an opening 41 through the center of first disk shaped plate 40 which may have any desired shape, such as a circular shape there through to help with the manufacture of the bottom support 34 as explained hereinafter.

The bottom support 34 has a second disk shaped plate 46 disposed directly above the first disk shaped plate 40. The second disk shaped plate 46 has a diameter with a range between 10 and 36 inches. There is a central opening 47 through the plate 46 which may have any desired shape, such as a circular shape. Further, there are four holes 48*a*, 48*b*, 48*c*, and 48*d* (48*a*-48*d*) formed through the second disk shaped plate 40, which located to allow the four bolts 37*a*-37*d* to extend there through, as described hereinafter. Disc shaped plate 46 can include a number of holes 49 there through to receive screws 54, as described herein after.

The convex shaped, rotating platform 16, as shown in FIG. 2A, is constructed by placing the bottom support plate 34 with bolts 37*a*-37*d* extending outward through the four openings 33*a*-33*d* in the bottom of a mold (not shown). Next, the first disk shaped plate 40 is mounted onto the upper surface of the metal plate 34 with the four bolts 37*a*-37*d* projecting upward through holes 40*a*-40*d*. Next, the second disk shaped plate 40 is mounted onto the upper surface of the first disk shaped plate 40 with the four bolts 37*a*-37*d* projecting upward through holes 40*a*-40*d*.

The next step is to pour the elastomer or rubber, in liquid form into the mold, such as through the holes 47, 41 and 33*e* of second disk shaped plate 40, first disk shaped plate 40 and support plate 33, respectively, so that the rubber fills the mold and the space around the bundle of plates to form the convex shaped, rotating platform 16.

An upper bundle of plates 45 includes a metal support plate 25, a third disk shaped plate 50, a stabilizing wear ring 52, fourth disk shaped plate 60, and a fifth disk shaped plate 70.

The third disk shaped plate 50 contains a plurality of openings 53 there through can be secured to the shaped plate 46 with screws 54. The screws 54 can extend through the holes 53 and mount to holes 49 in disc shaped plate 46 which are disposed at locations corresponding to the plurality of openings 53 through the third disk shaped plate 50, and through which the screws 54 are disposed. The third disk shaped plate 50 has a diameter with a range between 12 inches and 48 inches. There is an opening 56 within the third disk shaped plate 50 which corresponds in shape to the metal plate 25 disposed at the end 32*b* of post container 32. The four bolts 37*a*-37*d* project out through opening 56 when the third disk shaped plate 50 is secured to the second disk shaped plate 40.

A fourth disk shaped plate 60 having a plurality of openings 62 there through can be secured to the third disk shaped plate 50 with screws 54. The screws 54 can extend through the openings 62 and mount to holes 52 in disc shaped plate 50 which are disposed at locations corresponding to the plurality of openings 62 dispersed throughout the fourth disk shaped plate 60, and through which the screws 54 are disposed. The fourth disk shaped plate 60 has a diameter with a range between 12 inches and 48 inches. There is an opening 64 within the fourth disk shaped plate 60 which corresponds in shape to the metal plate 33 disposed at the end 32*b* of post container 32. The four bolts 37*a*-37*d* project out through opening 64 when the fourth disk shaped plate 60 is secured to the third disk shaped plate 50.

A stabilizing wear ring 52, typically constructed of wood, plastic and/or rubber, is disposed between the third disk shaped plate 50 and the fourth disk shaped plate 60. There is a plurality of openings 66 in a continuous ring pattern dispersed throughout the fourth disk shaped plate 60, through which screws 66 are disposed to securely attach the fourth disk shaped plate 60 to the stabilizing wear ring 52. The stabilizing wear ring 52 is designed to prevent the horse shaped riding trainer 10 from tipping over in the event that the rider 18 loses control. It sets a prescribed amount of tilt that is allowed for the riding trainer 10. The stabilizing wear ring 52 may have a variety of circumferences, with a range between 38 inches and 150 inches. In operation, the larger the circumference of the stabilizing wear ring 52, the less the titling ability of the riding trainer 10. Therefore, for inexperienced riders 18 of the riding trainer 10, a larger circumference of the stabilizing wear ring 52 is generally preferred. This can be accomplished by utilizing a stabilizing wear ring 52 with a larger ring shaped surface 52*a*.

The stabilizing wear ring 52 is preferably easy to interchange, such that as a rider 18 becomes more experienced, he may substitute a different stabilizing ring to make the riding trainer 10 more challenging. As illustrated, the stabilizing wear ring 52 contains a plurality of openings 66 which correspond to the plurality of openings 62 dispersed throughout the second fourth disk shaped plate 60, and through which the screws 66 are disposed.

After the fourth disk shaped plate 60 is secured to the third disk shaped plate 50 with the stabilizing ring 52 disposed therebetween, the three components 60, 50 and 52 can be secured to the second disk shaped plate 40 forming the upper end of the convex shaped, rotating platform 16. Next, the plate 25 at the end of the post container 32 is placed through the opening 64 within the fourth disk shaped plate 60, the opening 56 within the third disk shaped plate 50, and is securely mounted to the bolts 37*a*-37*c* so that the post container 32 is tightly mounted to the convex shaped, rotating platform 16.

Next, a fifth disk shaped plate 70 is slid over the post container 32 through an opening 72, preferably having a cross-section corresponding to the cross-section of the post container 32, within the center of the plate. Thus, the underside 73 of the fifth disk shaped plate 70 rests above the top surface of the fourth disk shaped plate 60. The upper surface 70*a* of the fifth disk shaped plate 70 is generally smooth, with the exception of the opening 72, and designed to be aesthetically pleasing, and cover the various other disk shaped plates, as described below. The fifth disk shaped plate 70 has a diameter with a range between 14 inches and 50 inches. The fifth disk shaped plate 70 is generally constructed of wood, although any desired materials may be used, such as plastic, metal, etc.

A second bottom end 28*b* of the post 28 is inserted through a corresponding opening 32*a* at first top end of the post container 32. The post container 32 is approximately the same height as the post 28, and mirrors the shape of the post to allow the post to be securely enclosed within the post container. Post container 32 includes one or more holes 32*a* through the post. These holes 32*a* corresponds in size and dimension to the plurality of openings 30 on the post 28. After the post 28 has been inserted through the first top end 32*a* of the post container 32, it can be slidably adjusted to various heights, by raising or lowering the post to a desired height, and inserting a peg or bolt 39 through the opening 32*a* through the post container 32, and then through the desired openings 30 within the post 28. By adjusting the height of the post 28 with respect to the post container 32, the location of the horse shaped structure 12 atop the post 14 is adjusted to accommodate riders 18 of various heights.

Figure 4:
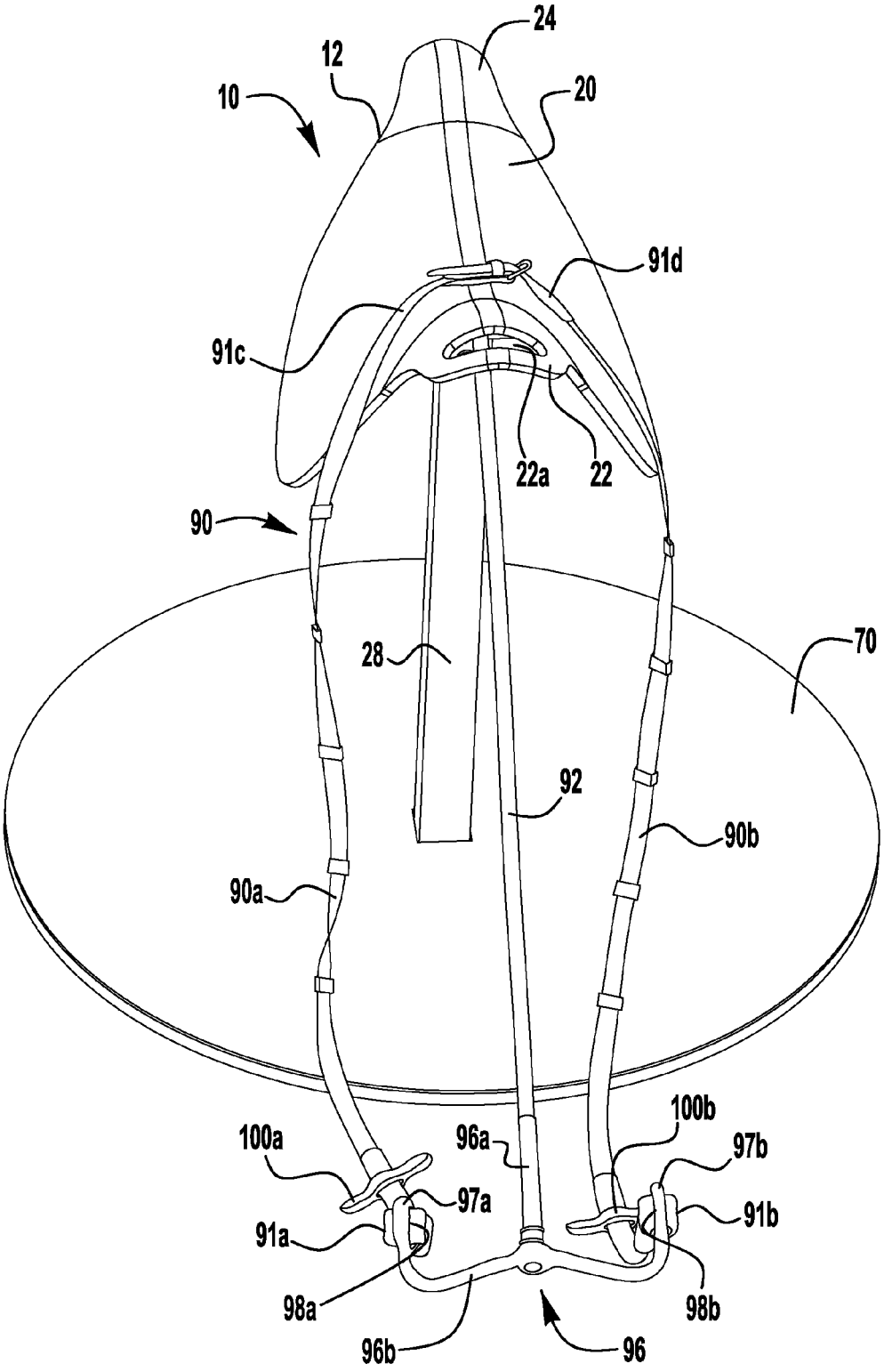
FIG. 4 is a front three dimensional view of the riding trainer complete with reins, in accordance with the present invention.
Figure 5:
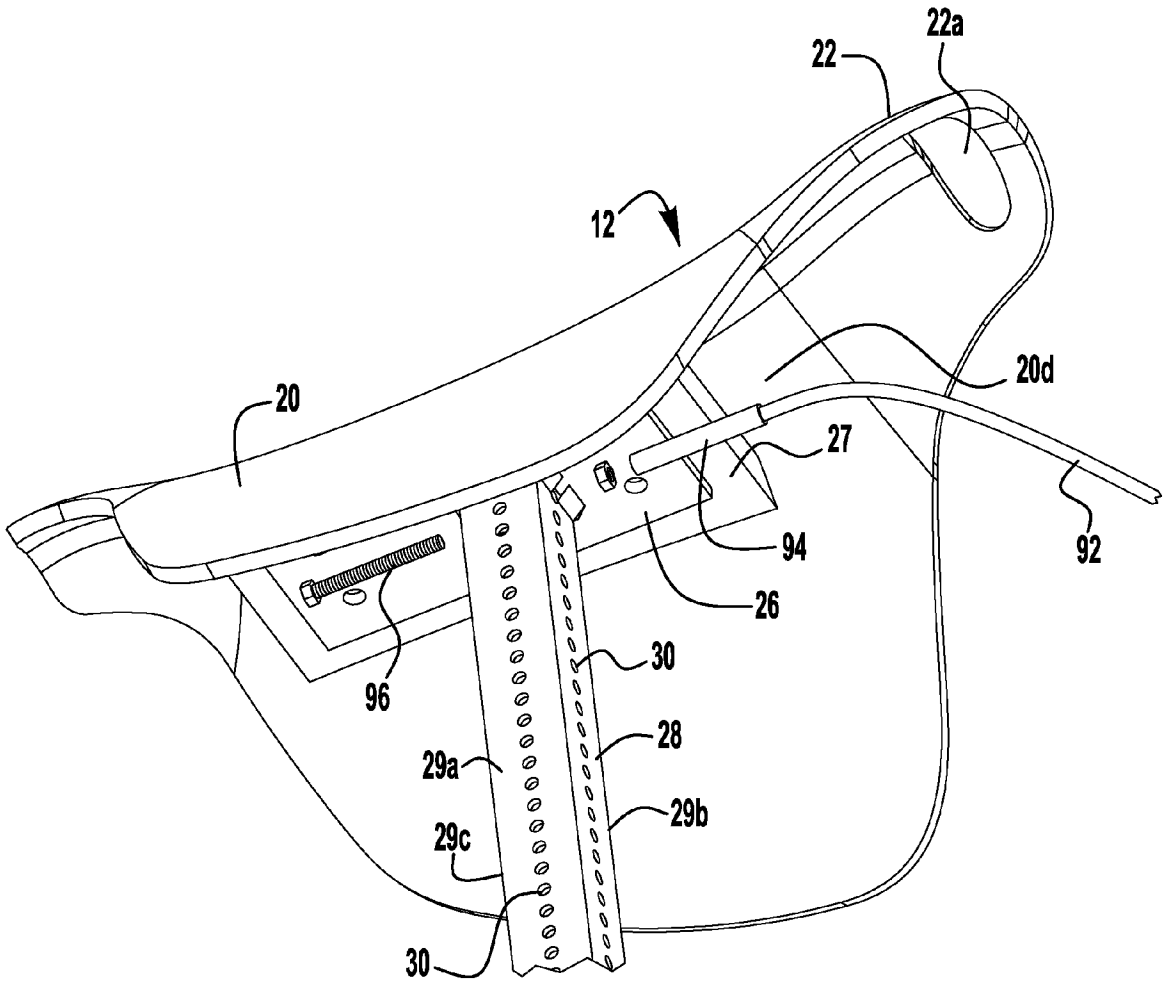
FIG. 5 is a bottom three dimensional exploded view of the riding trainer complete with reins, in accordance with the present invention.

FIGS. 4 and 5 illustrate an optional embodiment of the saddle trainer 10, in which reins or strap 90 are utilized. An elongated shaft 92 is secured to the post 28 which in turn is attached to reins 90 for the rider 18 to hold and simulate the experience of riding on a genuine horse. There is a first connection rod 94 that is bolted by a bolt 96 to post 28. The bolt 96 is mounted to the post 28 through an opening 30 and then to connection rod 94 attached to an end of elongated shaft 92. The height of the reins 90 are readily adjustable, since the connection rod 94 can be attached to any of the corresponding openings 30 extending along each of the four walls 29*a*-29*d* of shaft 28. The elongated shaft 92 may be of any desired length, with a range between 12 inches and 48 inches. The elongated shaft 92 is attached to the connection rod 94 in any desired fashion, such as by welding. The elongated shaft 92 generally slopes downward until it reaches a strap mounting unit 96, where it attaches to a second connection rod 96*a*, which as an element of the strap mounting unit. The strap mounting unit 96 has two identical strap mounting elements 97*a* and 97*b*, each of which extend from a central portion 96*b* of the strap mounting unit. Each of the strap mounting elements 97*a* and 97*b* has an opening 98*a* and 98*b*, respectively, through which one of the straps or reins 90*a* and 90*b*, respectively attaches.

The strap 90 is typically constructed of leather or fabric, and has a length with a range between 24 inches and 96 inches. The straps 90*a* and 90*b* have a first end 91*a* and 91*b* and a second end 91*c* and 91*d*, respectively. Each of the first ends 91*a* and 91*b* is formed into a loop, whereby each of the first end and second end are threaded through openings 98*a* and 98*b*, respectively, of the strap mounting elements 97*a* and 97*b*, and secured thereto. There are weighted mounts 100*a* and 100*b*, disposed adjacently to the first end 91*a* and 91*b*, respectively, to maintain the position of the straps 90*a* and 90*b*. The strap may be secured to the main body 20 of the saddle trainer 10 in any desired manner such as attached to a saddle not shown.

In operation, the horse shaped riding trainer 10 provides a unique neuromuscular stimulation through its one of a kind movement. The rider's pelvis moves with the same rotation and side-to-side movement that occurs when on horseback. Riding the Home Horse allows you to create a gentle, repetitive movement. The rider makes use of the entire body to control and maintain balance using natural body movements to achieve the desired rhythmic pelvic motion. Riders of the horse shaped riding trainer 10 often achieve greater flexibility, core muscle strength, and balance. A person positions their body on the horse shaped riding trainer 10 as follows: 1. The rider sits in the center of the horse shaped structure 12 with the hand cutout 22*a* facing forward; 2. The torso is in the natural upright position; 3. The pelvis is tipped slightly forward; 4. The weight of the body rests on the seat bones; 5. The back is held in its natural curve; 6. The head is held upright, but not stiffly on top of the shoulders; 7. The chest is open, but not thrown outwards; 8. The leg is extended downward with no inward gripping of the knee; 9. The lower leg is relaxed with feet flat and the toes gently upward; 10. The shoulder, hip and heel should form a vertical line; 11. The rider should now be positioned in the center of gravity. The rider will know they have achieved the correct position if they can sit still and the horse shaped riding trainer 10 stays centered; and 12. The rider then moves their hips forward and backward remembering to keep them disengaged from the legs and upper torso. As the rider makes progress they can move gently in any direction that is comfortable.

The horse shaped riding trainer 10 can be used for the following the exercises: Mounting and dismounting; Balanced sitting; Rocking forward; Rocking backward; Rocking sideways; Rocking around 360°; Extending arms overhead; Extending arms outstretched to side; Holding arms outstretched forward and then overhead, with a pole or stick grasped with both hands; Swinging arms alternatively forward and backwards; Rotating the trunk with arms outstretched; Standing on the platform turning side to side; Turning side to side while sitting; and Reaching down to touch left and right lower leg.

More advanced exercises include riding with saddle, stirrups and reins in the sitting position, the jumping position and doing some of the above exercises in both positions.

Although the invention has been shown and described with respect to a certain preferred embodiment or embodiments, certain equivalent alterations and modifications will occur to others skilled in the art upon the reading and understanding of this specification and the annexed drawings. In particular regard to the various functions performed by the above described components (assemblies, devices, etc.) the terms (including a reference to a "means") used to describe such components are intended to correspond, unless otherwise indicated, to any component which performs the specified function of the described component (i.e., that is functionally equivalent), even though not structurally equivalent to the disclosed structure which performs the function in the herein illustrated exemplary embodiments of the invention. In addition, while a particular feature of the invention may have been disclosed with respect to only one of several embodiments, such feature may be combined with one or more features of the other embodiments as may be desired and advantageous for any given or particular application.

The invention claimed is:

1. A horse shaped riding trainer, comprising:

a horse shaped riding structure including a main body having a front end portion incorporating the gripping portion and a rear end portion that extends in an upward slope from the main body to prevent the rider from sliding off the upper portion of the main body;

a convex shaped, rotating platform;

a post for mounting the horse shaped riding structure to the convex shaped, rotating platform, the post being an elongated, adjustable post having a plurality of openings along the length thereof;

a hollow, post container having an opening at one end to receive the elongated adjustable post;

a first support plate secured to one end of the elongated, adjustable post for mounting to an underside of the main body;

a second support plate secured to an opposite end of the hollow post container from the opening at one end for mounting the hollow post container to the convex shaped, rotating platform; and wherein the convex shaped, rotating platform includes:

a convex hemispherical shaped bottom support formed of a molded, elastic material with a lower bundle of plates molded therein.

2. The horse shaped riding trainer of claim 1 wherein the horse shaped riding structure includes:

an upper portion upon which a rider sits;

two sloping sidewall portions which support the legs of the rider; and a gripping portion for the rider to grip the horse shaped structure and sit astride the upper portion.

3. The horse shaped riding trainer of claim 2 wherein the gripping portion includes an opening through the front end portion of the main body to allow the rider to insert their hand for a more secure grip.

4. The horse shaped riding trainer of claim 1 wherein:

the lower bundle of plates includes a third support plate, a first disk shaped plate and a second disk shaped plate.

5. The horse shaped riding trainer of claim 4 wherein:

an upper bundle of plates includes the second support plate, at least a third disk shaped plate and a stabilizing wear ring attached to the third disk shaped plate.

6. The horse shaped riding trainer of claim 5 wherein the third support plate is secured to the second support plate.

7. The horse shaped riding trainer of claim 6 wherein the third disk shaped plate, the stabilizing wear ring, and a fourth disk shaped plate are secured to the second disk shaped plate forming the upper end of the convex shaped, rotating platform.

8. The horse shaped riding trainer of claim 7 wherein a fifth disk shaped plate having an opening within a center of the plate is disposed above a top surface of the fourth disk shaped plate.

9. The horse shaped riding trainer of claim 6 further including an elongated shaft secured at one end to the elongated, adjustable post and at a second end to a strap mounting unit.

10. The horse shaped riding trainer of claim 9 further including straps each having a looped first end which connect to the strap mounting unit.

11. A method of constructing a horse shaped riding trainer, comprising:

providing a horse shaped riding structure;

forming a convex shaped rotating platform;

mounting the horse shaped riding structure to the convex shaped, rotating platform with an elongated, adjustable post including an elongated, adjustable post having a plurality of openings along the length thereof and a hollow, post container having an opening at one end to receive the elongated adjustable post and a first support plate secured to an opposite end thereof;

constructing the convex shaped, rotating platform by placing a first disk shaped plate upon a second support plate, and mounting a second disk shaped plate to an upper surface of the first disk shaped plate to form a lower bundle; and molding the lower bundle with rubber into the convex shaped, rotating platform.

12. The method of claim 11 including mounting the first support plate of the hollow, post container to the second disk shaped plate of the lower bundle and securing the first support plate to the second support plate.

13. The method of claim 11 further including forming an upper bundle of plates including placing a third disk shaped plate upon the second support plate connected to an end of a post container, and mounting a stabilizing wear ring between the third disk shaped plate a fourth disk shaped plate.

14. The method of claim 13 further including placing a fifth disk shaped plate having an opening within a center of the plate above a top surface of the fourth disk shaped plate such that the post container extends above the fifth disk shaped plate.

15. The method of claim 14 further including:

mounting a first end of the elongated, adjustable post to the horse shaped riding structure; and inserting the second end e elongated, adjustable post into the post container.

16. A horse shaped riding trainer, comprising:

a horse shaped riding structure including a main body having a front end portion incorporating the gripping portion and a rear end portion that extends in an upward slope from the main body;

a convex shaped, rotating platform formed of a molded, elastic material with a lower bundle of plates molded therein;

a post for mounting the horse shaped riding structure to the convex shaped, rotating platform;

a hollow, post container having an opening at one end to receive the post;

a first support plate secured to one end of the post for mounting to an underside of the main body; and a second support plate secured to an opposite end of the hollow post container from the opening at one end for mounting the hollow post container to the convex shaped, rotating platform.

17. The horse shaped riding trainer of claim 16, wherein:

the lower bundle of plates includes a third support plate, a first disk shaped plate and a second disk shaped plate.

18. The horse shaped riding trainer of claim 17 wherein:

an upper bundle of plates includes the second support plate, at least a third disk shaped plate and a stabilizing wear ring attached to the third disk shaped plate.

19. A method of constructing a horse shaped riding trainer, comprising:

providing a horse shaped riding structure;

forming a convex shaped, rotating platform by placing a first disk shaped plate upon a second support plate, and mounting a second disk shaped plate to an upper surface of the first disk shaped plate to form a lower bundle; and mounting the horse shaped riding structure to the convex shaped, rotating platform with an elongated post and a hollow, post container having an opening at one end to receive the elongated post and a first support plate secured to an opposite end thereof.

* * * * *